US007225501B2

(12) United States Patent
Gordon et al.

(10) Patent No.: US 7,225,501 B2
(45) Date of Patent: Jun. 5, 2007

(54) BRUSH ASSEMBLY FOR A CLEANING DEVICE

(75) Inventors: Evan A. Gordon, Canton, OH (US); Kevin L. Thomas, North Canton, OH (US); Adam C. Sclafani, North Canton, OH (US)

(73) Assignee: The Hoover Company, North Canton, OH (US)

( * ) Notice: Subject to any disclaimer, the term of this patent is extended or adjusted under 35 U.S.C. 154(b) by 632 days.

(21) Appl. No.: 10/664,457

(22) Filed: Sep. 17, 2003

(65) Prior Publication Data

US 2005/0055797 A1 Mar. 17, 2005

(51) Int. Cl.
*A47L 11/30* (2006.01)

(52) U.S. Cl. ..... 15/320; 15/50.1; 15/385

(58) Field of Classification Search ..... 15/50.1, 15/180, 320, 322, 340.3, 385
See application file for complete search history.

(56) References Cited

U.S. PATENT DOCUMENTS

| | | | | |
|---|---|---|---|---|
| 1,865,032 | A * | 8/1932 | McGee | 15/49.1 |
| 1,925,925 | A * | 9/1933 | Kintzing | 15/50.1 |
| 2,021,608 | A * | 11/1935 | Petty | 15/180 |
| 2,066,068 | A | 12/1936 | Cooke | |
| 3,460,184 | A | 8/1969 | Dyer | |
| 4,014,064 | A | 3/1977 | Okazaki | |
| 4,037,369 | A * | 7/1977 | Campbell | 451/532 |
| 4,074,385 | A * | 2/1978 | Howard et al. | 15/180 |
| 4,114,225 | A * | 9/1978 | Malish et al. | 15/230.17 |
| 4,182,001 | A * | 1/1980 | Krause | 15/320 |
| 6,574,823 | B1 | 6/2003 | Stegens | |
| 6,766,556 | B2 * | 7/2004 | Gergek | 15/320 |

FOREIGN PATENT DOCUMENTS

| | | |
|---|---|---|
| EP | 0268284 A3 | 5/1988 |
| WO | WO 95/28123 A1 | 10/1995 |

* cited by examiner

*Primary Examiner*—Terrence R. Till
(74) *Attorney, Agent, or Firm*—Renner, Kenner, Greive, Bobak, Taylor & Weber

(57) ABSTRACT

A cleaning device for cleaning a surface is provided including a base for movement along a surface, a suction nozzle associated with the base, and a suction source for drawing liquid and dirt from the surface through the suction nozzle. The cleaning device further includes a brush assembly operatively connected to the base, wherein the brush assembly has at least one brush, which includes a first set of pliable elements extending downwardly from the brush and contacting the surface. The pliable elements slope downwardly and outwardly with the first set of pliable elements having at least a first group of pliable elements and a second group of pliable elements, wherein each of the pliable elements of the second group of the first set extend downwardly from the brush at a length less than the first group of the first set and the second group of pliable elements of the first set being positioned inwardly from the first group of the pliable elements of the first set.

11 Claims, 9 Drawing Sheets

BRUSH ASSEMBLY FOR A CLEANING DEVICE

BACKGROUND OF THE INVENTION

1. Field of the Invention

The present invention relates to a brush assembly for a cleaning device such as a carpet or hard floor cleaner. More particularly, the present application pertains to such a brush assembly that has pliable elements designed and constructed for agitating an uneven surface.

2. Background Information

It is known in the prior art to provide a cleaning device having a brush assembly for scrubbing of a cleaning surface being cleaned. One example of a cleaning device with a vertical axis brush assembly is illustrated by commonly-owned pending U.S. patent application having Ser. No. 09/955,725 and publication number 20030051308 to Morgan, et al. Other devices or machines have roller-type brush assemblies: such as that disclosed in U.S. Pat. No. 6,041,472 issued to Kasen, et al., or fixed brush assemblies, such as that illustrated by commonly-owned patent application having Ser. No. 10/340,291 to Gerber, et al. Typically, brush assemblies from these and other machines have trouble cleaning grout, recessed, or other uneven areas of the cleaning surface.

Hence, it is an object of the present invention to provide a brush assembly for a cleaning device with improved cleaning of grout, recessed or other uneven areas of the cleaning surface.

SUMMARY OF THE INVENTION

The foregoing and other objects of the present invention will be readily apparent from the following description and the attached drawings. In one aspect of the present invention, a cleaning device for cleaning a surface is provided. The cleaning device includes a base for movement along a surface, a suction nozzle associated with the base, and a suction source for drawing liquid and dirt from the surface through the suction nozzle. The cleaning device further includes a brush assembly operatively connected to the base, wherein the brush assembly has at least one brush, which includes a first set of pliable elements extending downwardly from the brush and contacting the surface. The pliable elements slope downwardly and outwardly with the first set of pliable elements having at least a first group of pliable elements and a second group of pliable elements, wherein each of the pliable elements of the second group of the first set extend downwardly from the brush at a length less than the first group of the first set and the second group of pliable elements of the first set being positioned inwardly from the first group of the pliable elements of the first set.

In another aspect of the invention, a cleaning device for cleaning a surface in which cleaning solution is dispensed to the surface and substantially simultaneously extracted along with the dirt on the surface in a continuous operation is provided. The cleaning device includes a base for movement along a surface and a recovery system mounted to the base. The recovery system includes a suction nozzle and a suction source for drawing liquid and dirt from the surface through the suction nozzle. The cleaning device further includes a liquid distribution system for dispensing liquid to the surface, and a brush assembly operatively connected to the base, wherein the brush assembly has at least one brush including a first set of pliable elements extending downwardly from the brush and contacting the surface with the pliable elements of the first set sloping downwardly and outwardly. The brush includes a second set of pliable elements extending downwardly from the brush and contacting the surface, wherein the second set of pliable elements is located inwardly from the first set of pliable elements. The brush has at least one opening for dispensing the liquid to the cleaning surface with the opening located between said first and second sets of pliable elements.

In still another aspect of the invention, a cleaning device for cleaning a surface is provided. The cleaning device includes a base for movement along a surface, a suction nozzle associated with the base and a suction source for drawing liquid and dirt from the surface through said suction nozzle. A brush assembly is operatively connected to the base, wherein the brush assembly has at least one brush including a first set of pliable elements extending downwardly from the brush and contacting the surface. The first set of pliable elements has at least a first pliable element extending a first length, at least a second pliable element extending a second length greater than the first length of the first pliable element, and at least a third pliable element extending a third length greater than the second length of the second pliable element, wherein the first pliable element is positioned inwardly from the second pliable element, and the second pliable element is positioned inwardly from the third pliable element.

BRIEF DESCRIPTION OF THE DRAWINGS

The invention will now be described, by way of example, with reference to the attached drawings, of which.

DETAILED DESCRIPTION OF THE PREFERRED EMBODIMENT

Figure 1:
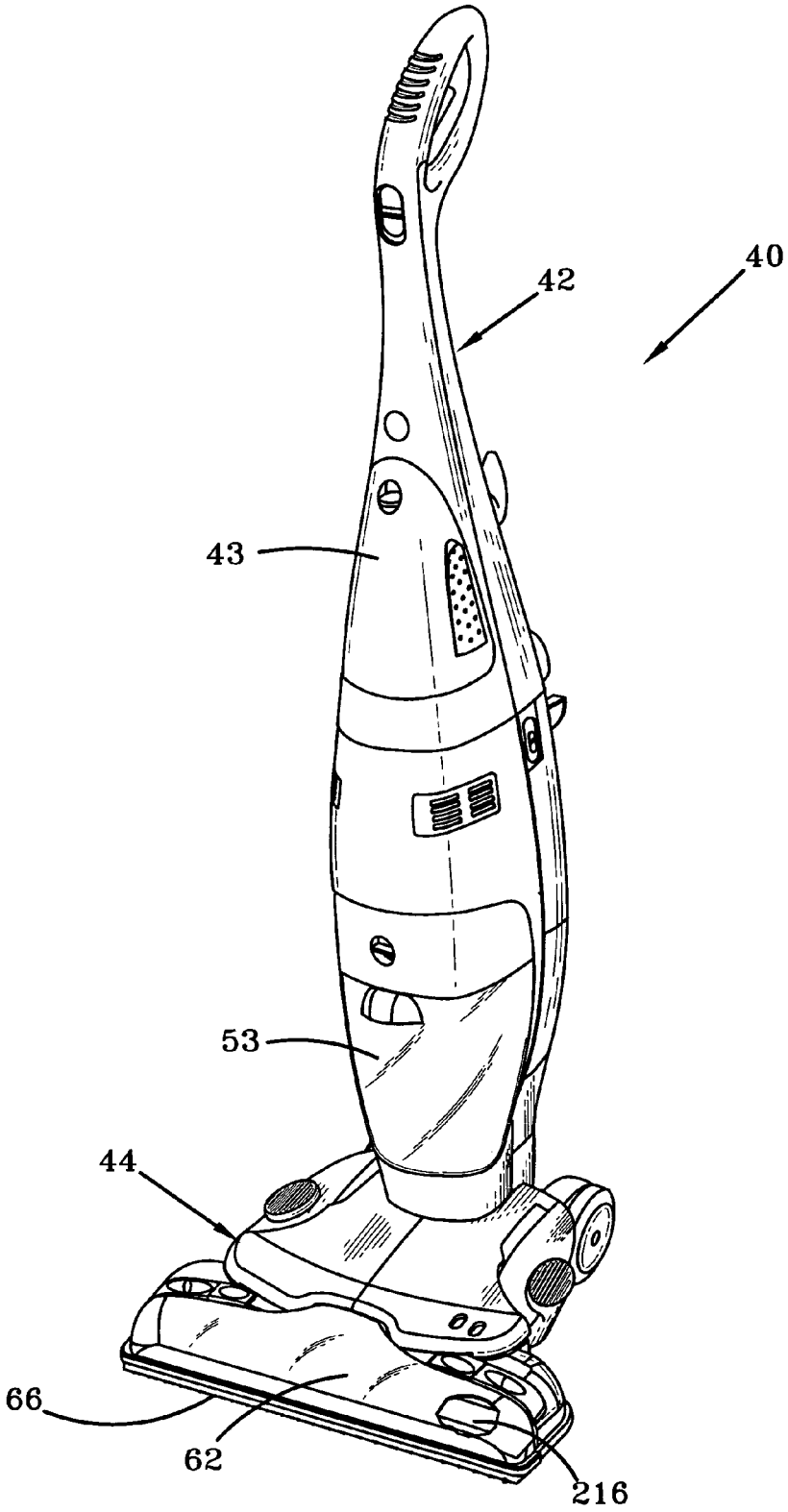
FIG. 1 is a perspective view of one embodiment of a floor-cleaning device with a portion cut away to show the brush assembly according to the present invention.

Referring to the drawings, FIG. 1 depicts a perspective view of an upright hard floor-cleaning unit 40 having a brush assembly of one embodiment of the present invention. The hard floor-cleaning unit 40 comprises an upright handle assembly 42 pivotally connected to the rear portion of a base assembly 44 that moves and cleans along a surface. The base assembly 44 includes a nozzle assembly 62 with a squeegee 66 for recovering particles and/or fluid from the floor and a brush block assembly 216 (FIG. 2A) for scrubbing the floor. The handle assembly 42 includes a recovery tank 53 for collecting the particles and/or fluid picked up by the nozzle assembly 62 and a solution distribution system having a solution tank 43 containing cleaning solution for distribution on the floor. Both the nozzle assembly 62 and brush block assembly 216 are removable from the base assembly 44. Further details of the cleaning unit 40 are disclosed in the co-pending patent application Ser. No. 09/956,297, the disclosure of which is incorporated by reference.

Figure 2:
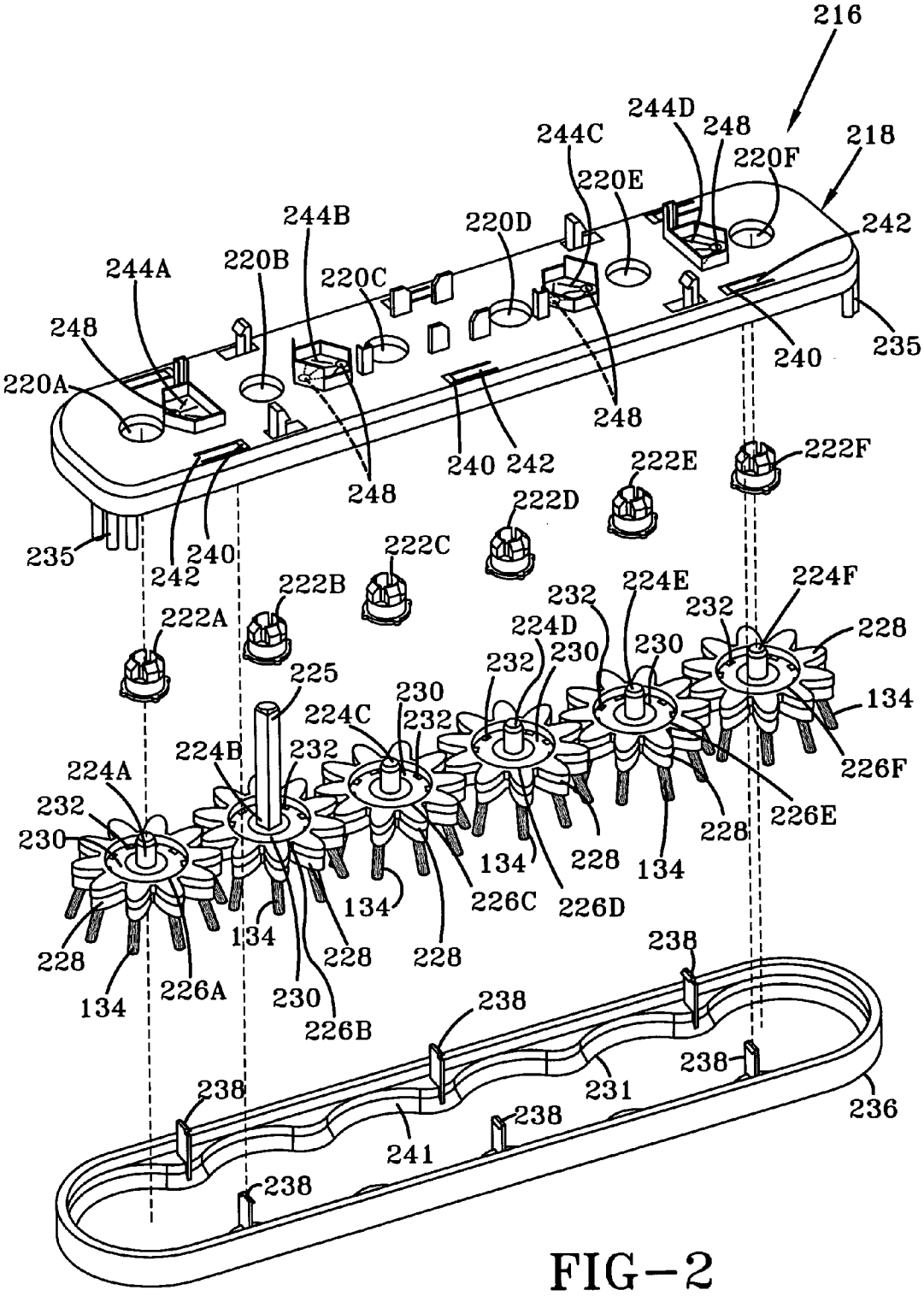
FIG. 2 is an exploded view of the brush assembly of the embodiment in FIG. 1.

Referring to FIG. 2, the brush block assembly 216 comprises a brush support plate 218 having six spaced-apart openings 220A, 22GB, 220C, 220D, 220E, and 220F. Fixedly received within the openings 220 are bushings 222A, 222B, 222C, 222D, 222E, and 222F which, in turn, rotatingly receive axial shafts 224A, 224B, 224C, 224D, 224E, and 224F of gear brushes 226A, 226B, 226C, 226D, 226E, and 226F. The gear brushes 226A–F rotate on a vertical axis. A drive shaft 225 having a square cross section is welded to the axial shaft 224B of the gear brush 226B adjacent the right outer brush 226A. Each of the gear brushes 226 is basically configured as a spur gear having ten teeth 228 that intermesh such that when one gear brush 226 rotates, all other gear brushes 226 rotate accordingly. The center hub of gear brushes 226 forms a hollow, downwardly-projecting cup 230 having a multiplicity of openings 232 circumscribing the bottom thereof for dispensing the cleaning solution from the solution tank 43 to the cleaning surface.

A gear guard 236 snap fits into a brush support plate 218. Specifically, upwardly extending locking tabs 238 on the gear guard 236 catch onto steps 240 integrally molded to the lower surface of the brush support plate 218. During assembly of the gear guard 236 to the brush support plate 218, the locking tabs 238 deflect laterally extending cantilevered tangs 242 integrally formed in the brush support plate 218 to allow the locking tabs 238 to extend therethrough. The tangs 242 will then flex back to their initial position, closely adjacent the locking tabs 238, to prevent the locking tabs 238 from disengaging off of the steps 240.

With continued reference to FIG. 2, the brush support plate 218 includes a plurality of troughs 244A, 244B, 244C, 244D for receiving the cleaning solution that flows from a distributor 246 (FIG. 2A) positioned thereon. Cleaning solution received in the troughs 244 flows through openings 248 in them and into the center cups 230 of the brushes 226. Once deposited within the center cup 230, the cleaning solution flows outward toward the surface being cleaned through openings 232 in the bottom of the center cups 230. The cups 230 contain the cleaning solution as the gear brushes 226 rotate and, thus, prevent solution from being sprayed outward over the top of the gear brush 226. The gear guard 236 is designed to withstand impact and prohibit cleaning solution from resting on its inner lip 231. In particular, the bottom surface 241 of the inner lip 231 inclines downwardly to the edge of the inner lip 231 to direct the flow of cleaning solution off the inner lip 231.

Figure 3:
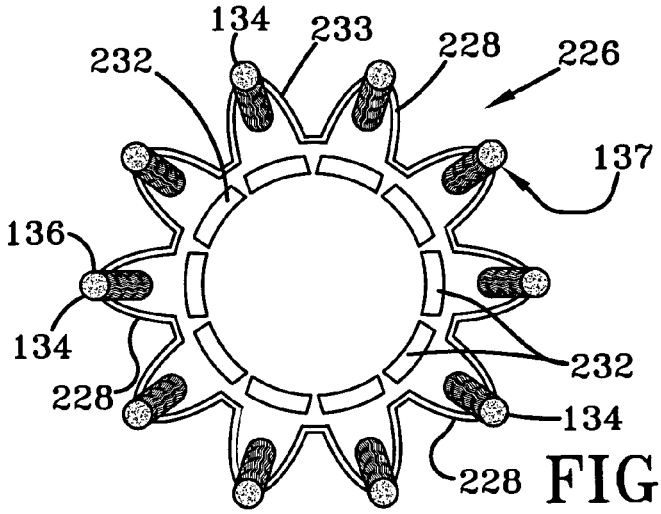
FIG. 3 is a bottom view of one of the gear brushes of the brush assembly shown in the embodiment of FIG. 2.
Figure 4:
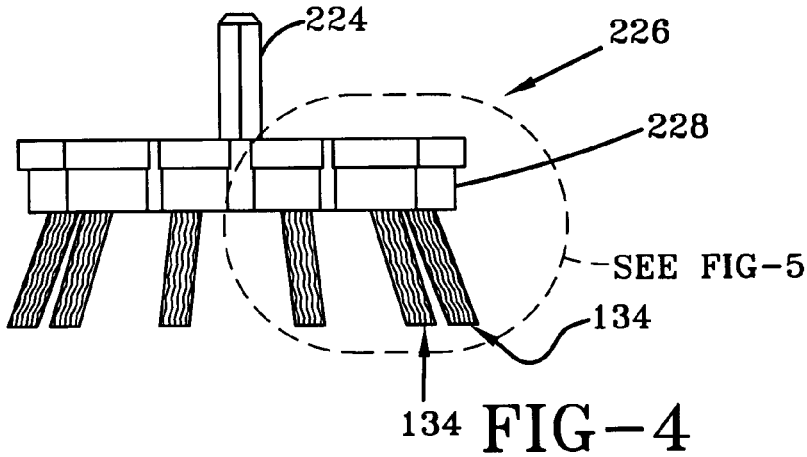
FIG. 4 is a side elevation view of the gear brush of FIG. 3.
Figure 5:
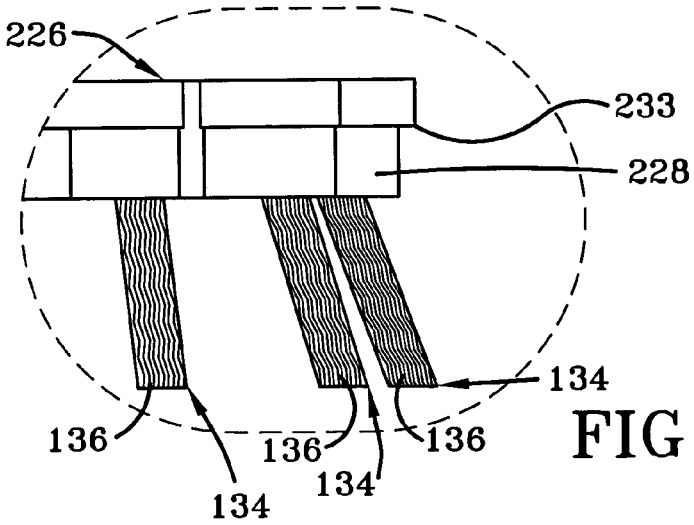
FIG. 5 is an enlarged view of the section of the gear brush circled in FIG. 4.

During manufacturing of the brush assembly 216, the gear brush axial shafts 224 are first inserted into the appropriate bushing 222, with gear brushes 226 in their uppermost position and with gear teeth 228 intermeshed between the gear brushes 226. As also seen in FIGS. 3, 4, and 5 each gear tooth 228 has a blind bore extending to offset 233 into which pliable elements in the form of bristles 136 define bristle bundles 134 which are compressively inserted therein and extend downwardly to the cleaning surface. The bristle bundles 134 are arranged in an outer ring 137 around the gear brushes 226, as seen in FIG. 3.

Each of the bristles 136 slope or flare outwardly with respect to the brush assembly 216 at an angle of twenty degrees with respect to the vertical axis of the gear brushes 226. The bristles 136 could slope outwardly at other angles too, such as, for example, those within the range often to thirty degrees. Such an outward sloping of bristles 136 allows the bristles 136 to flex at various heights, thereby allowing the bristles 136 to get into and scrub the grout or other recessed areas of the cleaning surface.

Figure 6:
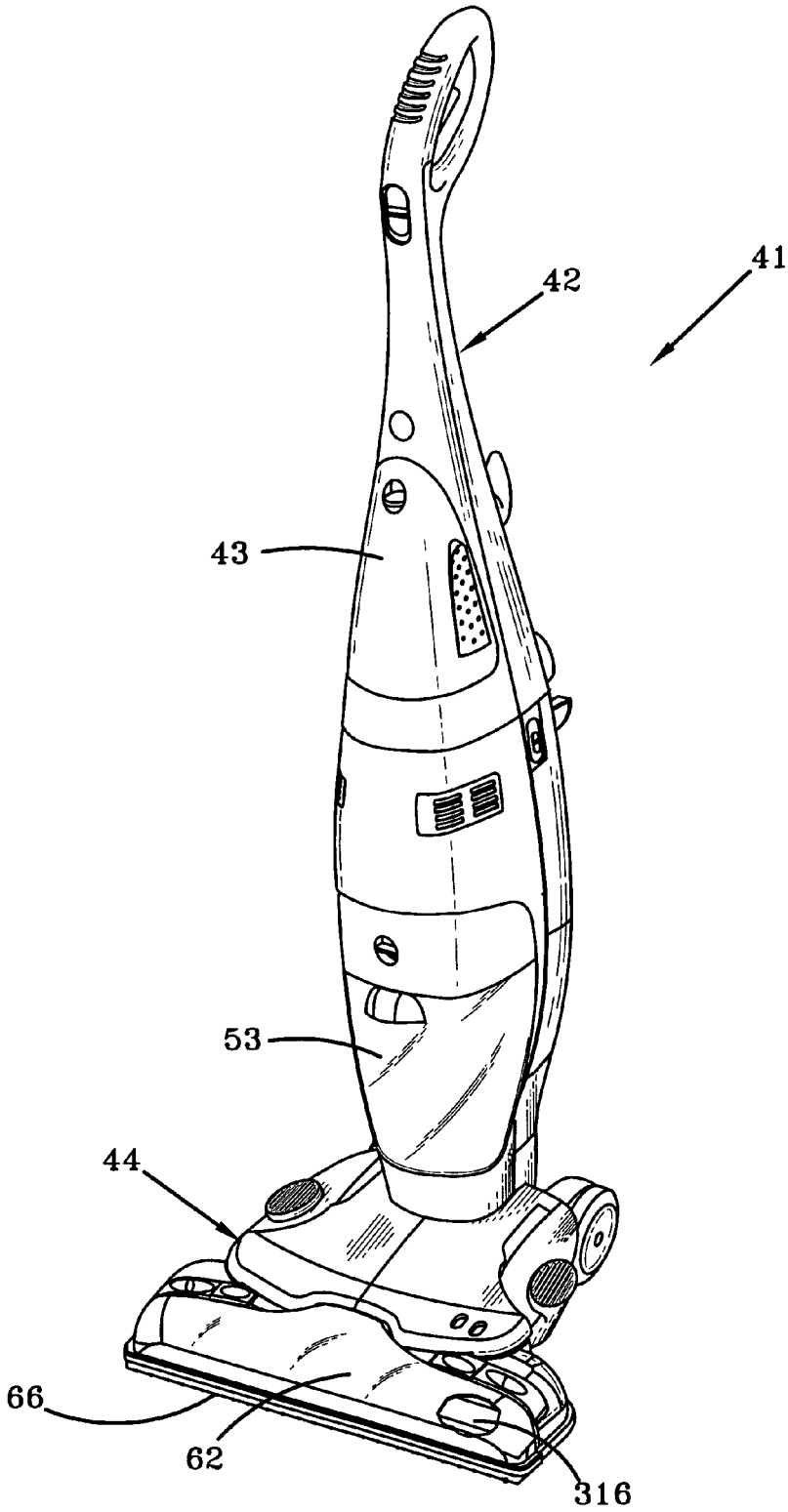
FIG. 6 is a perspective view of another embodiment of a floor-cleaning device with a portion cut away to show the brush assembly according to the present invention.
Figure 7:
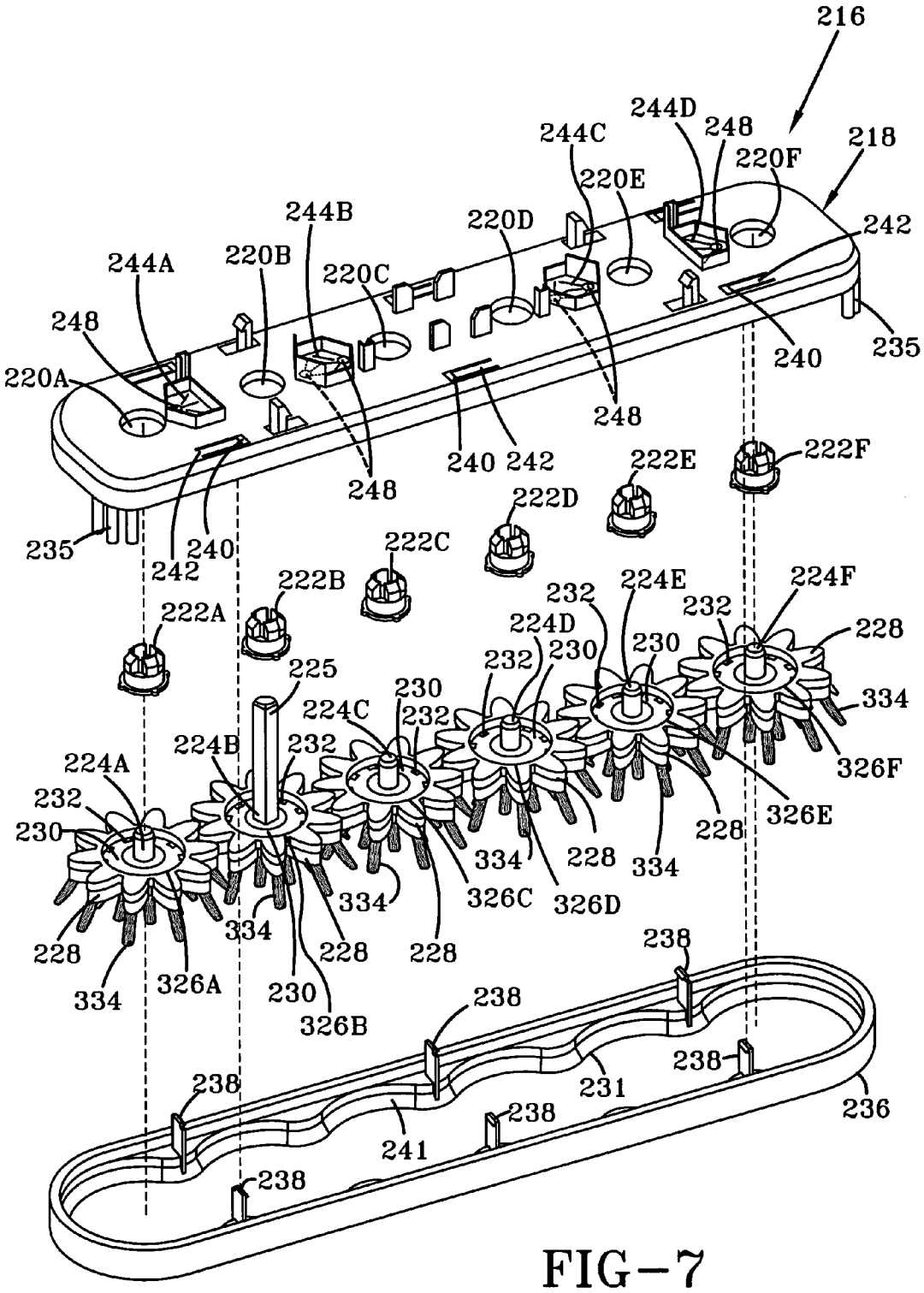
FIG. 7 is an exploded view of the brush assembly of the embodiment of FIG. 6.

FIGS. 6 through 10 depict another embodiment of the present invention. The same reference numbers will be used for elements that are similar in structure and function as the previous embodiment. As illustrated in FIG. 7, the brush block assembly 316 comprises a brush support plate 218 having six spaced-apart openings 220A, 220B, 220C, 220D, 220E, and 220F. Fixedly received within the openings 220 are bushings 222A, 222B, 222C, 222D, 222E, and 222F which, in turn, rotatingly receive axial shafts 224A, 224B, 224C, 224D, 224E, and 224F of gear brushes 326A, 326B, 326C, 326D, 326E, and 326F. The gear brushes 326A-F rotate on a vertical axis. A drive shaft 225 having a square cross section is welded to the axial shaft 224B of the gear brush 326B adjacent the right outer brush 326A. Each of the gear brushes 326 is basically configured as a spur gear having ten teeth 228 that intermesh such that when one gear brush 326 rotates, all other gear brushes 326 rotate accordingly. The center hub of gear brushes 326 forms a hollow, downwardly-projecting cup 230 having a multiplicity of openings 232 circumscribing the bottom thereof for dispensing the cleaning solution from the solution tank 43 to the cleaning surface.

Figure 8:
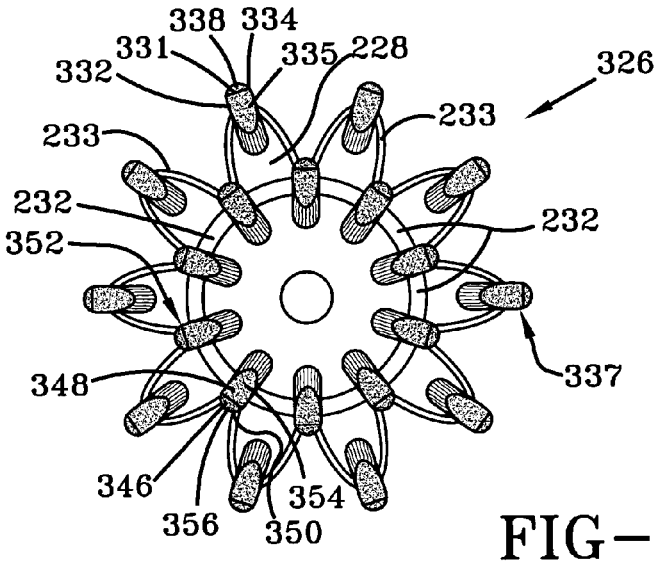
FIG. 8 is a bottom view of one of the gear brushes of the brush assembly shown in the embodiment of FIG. 6.
Figure 9:
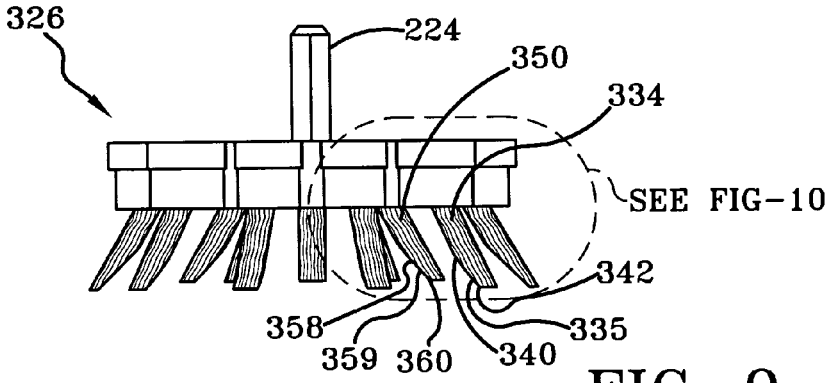
FIG. 9 is a side elevation view of the gear brush of FIG. 8.
Figure 10:
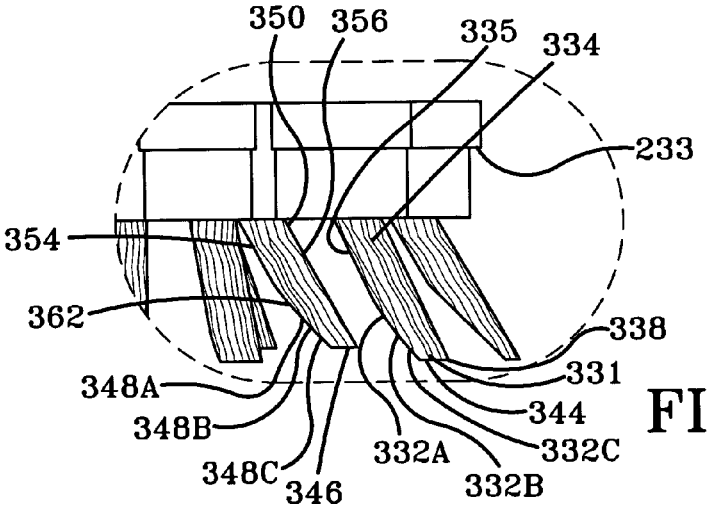
FIG. 10 is an enlarged view of the section of the gear brush circled in FIG. 9.

During manufacturing of the brush assembly 316, the gear brush axial shafts 224 are first inserted into the appropriate bushing 222, with gear brushes 326 in their uppermost position and with gear teeth 228 intermeshed between the gear brushes 326. As best seen in FIGS. 8–10, each gear brush 326 includes a gear tooth 228 having a blind bore extending to offset 233 into which pliable elements in the form of bristles 331, 332 define bristle bundles 334 which are compressively inserted therein and extend downwardly to the cleaning surface. The bristle bundles 334 are arranged in an outer ring 337 around the gear brushes 326. Each of the bristle bundles 334 includes inner and outer bristle groups 335, 338, respectively, that slope or flare outwardly with respect to the brush assembly 316 at an angle of thirty degrees with respect to the vertical axis of the gear brushes 326. The bristles 331 of the outer bristle group 338 are longer than the bristles 332 of the inner bristle group 335. The inner bristle group 335 is also trimmed outwardly at an angle of forty-five degrees with respect to the cleaning surface, such that the length of each successive bristle going from the inner end 340 to the outer end 342 of the inner group 335 is longer than that of the previous bristle. For example, as illustrated in FIG. 10, bristle 332C is longer than 332B, which is longer that 332A and so forth. Thus, when the bristles in each bristle bundle 334 are flexed outwardly, the tips 344 of the bristles 332 in the inner bristle group 335 contact the cleaning surface to provide better scrubbing action.

The gear brushes 326 further include a second set of bristles 346, 348 defining bristle bundles 350 which are received in blind bores and arranged in an inner ring 352 around the gear brushes 326. These bristle bundles 350 are shorter in length than the bristle bundles 334 of the outer ring 337. Each of the bristle bundles 350 includes inner and outer bristle groups 354, 356, respectively, that flare outwardly with respect to the brush assembly 316 at an angle of thirty degrees with respect to the vertical axis of the gear brush. The bristles 346 of the outer bristle group 356 are longer than those of the inner bristle group 354. The inner bristle group 354 is also trimmed outwardly at an angle of forty-five degrees with respect to the cleaning surface, such that the length of each successive bristle going from the inner end 358 to the outer end 360 of the inner bristle group 354 is longer than that of the previous bristle. For example, as illustrated in FIG. 10, bristle 348C is longer than 348B, which is longer than 348A and so forth. Thus, when the bristles in each bristle bundle 350 are flexed outwardly, the tips 362 of the bristles 348 in the inner bristle group 354 contact the cleaning surface to provide better scrubbing action. Also, the difference in height of bristle bundles 334 and 350 relative to the cleaning surface allow the longer bristle bundles 334 to clean grout areas or other recessed areas of the floor. Bristle bundles 235 are also compressively inserted into the front corners of the brush support plate 218 for edge cleaning, as shown in FIG. 7.

FIG. 6 shows an upright hard floor-cleaning unit 41 having the brush assembly 316. The hard floor-cleaning unit is similar to that shown in FIG. 1 except for the brush assembly as previously described. Thus, similar reference numbers will be used. The hard floor-cleaning unit 41 comprises an upright handle assembly 42 pivotally connected to the rear portion of a base assembly 44 that moves and cleans along a surface. The base assembly 44 includes a nozzle assembly 62 with a squeegee 66 for recovering particles and/or fluid from the floor and the brush block assembly 316 for scrubbing the floor. The handle assembly 42 includes a recovery tank 53 for collecting the particles and/or fluid picked up by the nozzle assembly 62 and a solution tank 43 containing cleaning solution for distribution on the floor. Both the nozzle assembly 62 and brush block assembly 316 are removable from the base assembly 44. Further details of the cleaning unit 41 are disclosed in the co-pending patent application Ser. No. 09/956,297, the disclosure of which is incorporated by reference. The bristle arrangement of the brush assemblies 216 and 316 of the above-mentioned embodiments can also be incorporated into the brush assembly shown in co-owned U.S. Pat. No. 6,009,593, the disclosure of which is incorporated by reference.

Figure 11:
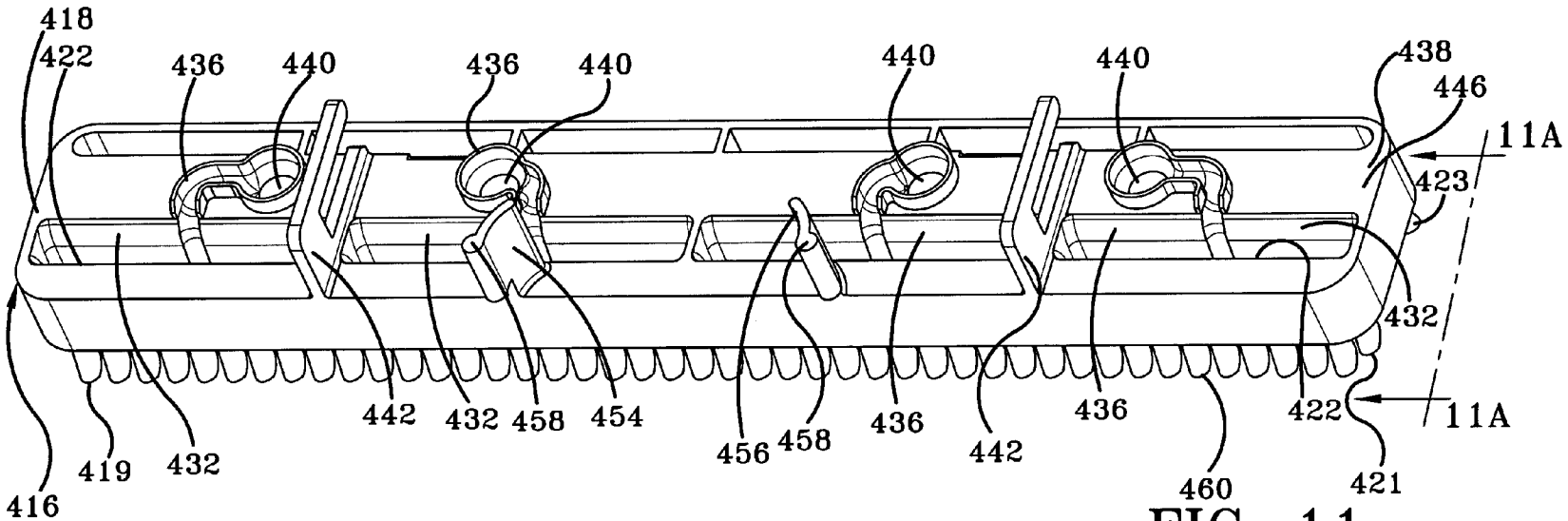
FIG. 11 is a perspective view of a brush assembly according to still another embodiment of the present invention.
Figure 11A:
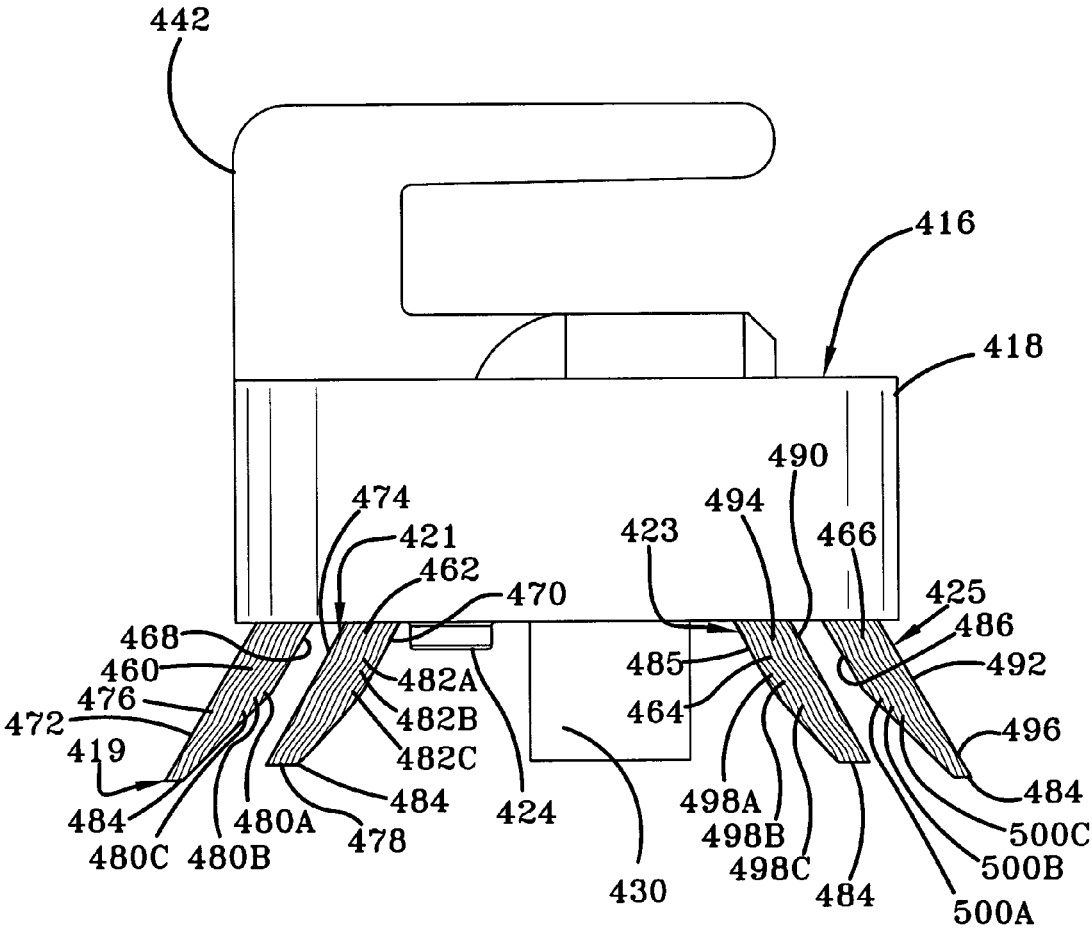
FIG. 11A is an enlarged elevation view taken along line 11A—11A of FIG. 11.

FIGS. 11 and 11A show still another embodiment of the brush block assembly 416. In particular, the brush assembly 416 comprises a rectilinear brush support member 418 having blind bores into which pliable elements in the form of bristles 476, 478, 480, 482, 494, 496, 498, 500 defining bristles bundles 460, 462, 464, 466 are compressively inserted therein. The brush assembly 416 includes an outer front row 419 of bristles 460, an inner front row 421 of bristle bundles 462, an inner rear row 423 of bristle bundles 464, and an outer rear row 425 of bristle bundles 466. The rows are parallel to the longitudinal axis of the brush support member 418 and also oriented transversely to the cleaning path. The bristle bundles project downwardly from the support member 418 for engagement with the cleaning surface. The bristles in the outer rows 419 and 425 are longer than the bristles in the inner rows 421 and 423.

Each of the bristle bundles 460, 462 include respective inner or rear bristle groups 468, 470 and respective outer or front bristle groups 472, 474 that slope or flare outwardly or forwardly with respect to the brush assembly 416 at an angle of thirty degrees with respect to the vertical axis of the brush assembly 416. The bristles 476, 478 of the respective outer bristle groups 472, 474 are longer than the bristles 480, 482 of the respective inner bristle groups 468, 470. Each of the inner bristle groups 468, 470 is also trimmed outwardly at an angle of forty-five degrees with respect to the cleaning surface, such that the length of each successive bristle going from the inner end to the outer end of the inner group 468, 470 is longer than that of the previous bristle. For example, as illustrated in FIG. 11A, bristles 480C and 482C are longer than 480B and 482B, which are longer than 480A and 482A and so forth. Thus, when the bristles in each of the bristle bundles 460, 462 are flexed outwardly, the tips 484 of the bristles 480, 482 in the respective inner bristle groups 468, 470 contact the cleaning surface to provide better scrubbing action.

Each of the bristle bundles 464 and 466 include respective inner or front bristle groups 485, 486 and respective outer or rear bristle groups 490, 492 that slope or flare outwardly or rearwardly with respect to the brush assembly 416 at an angle of thirty degrees with respect to the vertical axis of the brush assembly 416. The bristles 494, 496 of the respective outer bristle groups 490, 492 are longer than the bristles 498, 500 of the respective inner bristle groups 485, 486. Each of the inner bristle groups 485, 486 is also trimmed outwardly at an angle of forty-five degrees with respect to the cleaning surface, such that the length of each successive bristle going from the inner end to the outer end of the inner group 485, 486 is longer than that of the previous bristle. For example, as illustrated in FIG. 11A, bristles 498C and 500C are longer than 498B and 500B, which are longer than 498A and 500A and so forth. Thus, when the bristles in each of the bristle bundles 464, 466 are flexed outwardly, the tips 484 of the bristles 498, 500 in the respective inner bristle groups 485, 486 contact the cleaning surface to provide better scrubbing action.

The bristle bundles 460, 466 in the outer rows 419 and 425 are longer than the bristle bundles 462, 464 in the inner rows 421 and 423. This difference in height allows the longer bristle bundles 460, 466 to clean grout areas or other recessed areas of the floor.

As best shown in FIG. 11, the support member 418 further includes a line of elongated slots 422 spaced longitudinally and disposed between the front and rear edges of the support member 418. A dispensing bar 424 (FIG. 11A) is integrally formed with the bottom of the support member 418, underlying the bottom of slots 422. An additional scrub strip 430 (FIG. 11A) is adhesively mounted on the bottom of the support member 418 rearwardly adjacent the dispensing bar 424.

Together, the dispensing bar 424 and slots 422 define relatively deep compartments or troughs 432 in the support member 418, which break up bubbles of cleaning solution that collect therein. The relatively wide troughs 432 also allow easy rinsing and cleaning of dirt collected therein. Recessed channels 440 are disposed in the upper surface 438 of the support member 418 to direct the cleaning solution to flow into the troughs 432. Integrally formed on the top surface 446 of the support member 418 are splash guards 436 that surround the channels 440 to prevent the cleaning solution from splashing out of the channels 440. Since the troughs 432 are spaced apart, the collecting of cleaning solution in one area is minimized in case of an error occurring in molding an uneven dispensing bar 424. A pair of outwardly curved ribs 454, 456, which define a handgrip, is attached on the top surface 446 of the support member 418 near the front end. A nub 458 is formed at the forward end of each of the ribs 454, 456 for added grip support.

A pair of locating hooks 442 is attached to the top surface 446 of the support member 418 and extends rearwardly. The hooks 442 are slidably received in a base assembly of floor cleaning unit. Further details of the floor cleaning unit and base assembly are described in commonly-owned, co-pending patent application having Ser. No. 10/340,291 the disclosure of which is incorporated by reference. Optionally, the bristles bundles as a whole for each row may vary in length or height with respect to the cleaning surface. For example, one bristle bundle may be longer than its adjacent bristle bundles to the right and left of it in the row.

Figure 12:
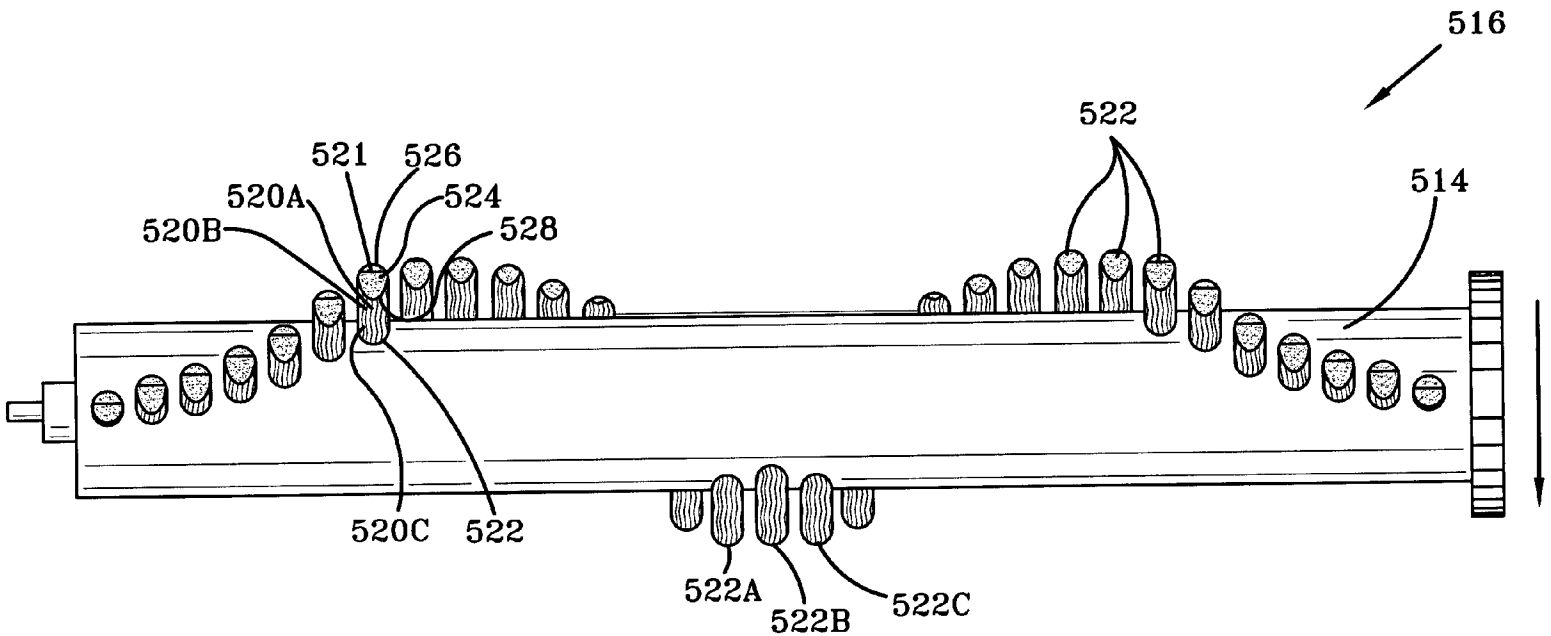
FIG. 12 is a front perspective view of a brush assembly according to still another embodiment of the present invention.

FIG. 12 illustrates another embodiment of the present invention. In this embodiment, the brush assembly 516 is a horizontal brush roll including a cylindrical drum 514 and a plurality of pliable elements in the form bristles 520 and 521 defining bristle bundles 522 secured to the drum 514 extending radially therefrom. The bristle bundles 522 are secured to the drum 514 in a generally helical pattern originating at each end of the drum 514 and terminating at the center of the drum 514.

Each of the bristle bundles 522 include inner and outer bristle groups 524, 526, respectively, as viewed when the bristle extends down and is located in front of the drum 514. Alternatively, each of the bristles 520 and 521 can slope or flare outwardly with respect to the brush assembly 516 (when the bristle extends down and is located in front of the drum 514) at an angle of thirty degrees with respect to a plane extending radially from the secured end of the bristle and oriented perpendicular to the horizontal axis of the brush assembly 516. The bristles 521 of the outer bristle group 526 are longer than the bristles 520 of the inner bristle group 524. The inner bristle group 524 is also trimmed outwardly at an angle of forty-five degrees with respect to a plane across the free ends of the bristles 521 of the outer bristle group 526, such that the length of each successive bristle going from the inner end to the outer end of the inner bristle group 524 is longer than that of the previous bristle. For example, bristle 520C is longer than 520B, which is longer than 520A and so forth. Thus, when the bristles in each bristle bundle 522 are flexed outwardly, the tips 528 of the bristles 520 in the inner bristle group 524 contact the cleaning surface to provide better scrubbing action. The bristle bundles 522, as a whole, for each row vary in length or height with respect to the cleaning surface. For example, bristle bundle 522B is longer than its adjacent bristle bundles 522A and 522C to the right and left of it in the helical row. The brush assembly 516 is rotatably mounted to several floor cleaning machines, such as the floor-cleaning machine 40 of FIG. 1 and the carpet extractors in co-owned U.S. Pat. No. 5,406,673 and U.S. Pat. No. 5,983,442, the disclosures of which are incorporated by reference. The brush assembly 516 is also rotatably mounted to floor cleaning machines, such as U.S. Pat. No. 6,041,472 issued in Kasen; U.S. Pat. No. 6,467,122 issued to Lenkiewicz; and U.S. Pat. Nos. 6,533,871 and 6,073,330 issued to Zahuranec, the disclosures of which are incorporated by reference. Brush assemblies 216, 316, and 416 from the previous embodiments can also be mounted to these floor-cleaning machines.

For all of the embodiments, each bristle is crimped instead of straight so that when the bundles are formed, more scrubbing coverage is provided. Such crimping on the bristles in the bundles also reduces deflection of the bristles as they scrub, thereby minimizing the spraying or splattering of cleaning solution from the bristles.

The present invention has been described by way of example using the illustrated embodiment. Upon reviewing the detailed description and the appended drawings, various modifications and variations of the preferred embodiment will become apparent to one of ordinary skill in the art. All such obvious modifications and variations are intended to be included in the scope of the present invention and of the claims appended hereto.

In view of the above, it is intended that the present invention not be limited by the preceding disclosure of a preferred embodiment, but rather be limited only by the appended claims.

What is claimed is:

1. A cleaning device for cleaning a surface comprising:

a base for movement along a surface;

a suction nozzle associated with said base;

a suction source for drawing liquid and dirt from said surface through said suction nozzle;

a brush assembly operatively connected to said base; and wherein said brush assembly having at least one brush including a first set of pliable elements extending downwardly from said brush and contacting the surface, said pliable elements sloping downwardly and outwardly, said first set of pliable elements having at least a first group of pliable elements and a second group of pliable elements, each of said pliable elements of said second group of said first set extending downwardly from said brush at a length less than said first group of said first set, said second group of pliable elements of said first set being positioned inwardly from said first group of said pliable elements of said first set, wherein said first set of pliable elements are arranged in separate bundles forming a ring around said brush, each of said bundles includes said first and second groups of pliable elements, said second group of pliable elements having at least a first pliable element extending a first length, at least a second pliable element extending a second length greater than the first length of said first pliable element, and at least a third pliable element extending a third length greater than the second length of said second pliable element;

wherein a substantial number of said pliable elements of said second group having an innermost pliable element and an outermost pliable element, each of said pliable elements having a working end, wherein said substantial number of said pliable elements are cut such that a plane extending from the bottom end of the innermost pliable element to the bottom end of the outermost pliable element is in the range of 40 to 50 degrees with respect to the cleaning surface.

2. The cleaning device of claim 1 including a liquid distribution system for dispensing liquid to said surface, a second set of pliable elements extending downwardly from said brush and contacting the surface, said second set of pliable elements located inwardly from said first set of pliable elements, said brush having at least one opening for dispensing the liquid to the cleaning surface, said opening being located between said first and second set of pliable elements.

3. The cleaning device of claim 1 including a second set of pliable elements extending downwardly from said brush and contacting the surface, said second set of pliable elements located inwardly from said first set of pliable elements, said second set of pliable elements having at least a first group of pliable elements and a second group of pliable elements, each of said pliable elements of said second group of said second set extending downwardly from said brush at a length less than said first group of pliable elements of said second set.

4. The cleaning device of claim 1 wherein said first pliable element is positioned inwardly from said second pliable element, said second pliable element is positioned inwardly from said third pliable element.

5. The cleaning device of claim 1 wherein said substantial number of said pliable elements of said second group are arranged in increasing length going from the innermost pliable element to the outermost pliable element.

6. The cleaning device of claim 1 wherein said each of said pliable element is angled outwardly in the range of 20 to 40 degrees with respect to an axis perpendicular to the cleaning surface.

7. The cleaning device of claim 6 wherein said brush assembly includes a plurality of said brushes, said brushes being gear brushes and arranged in a gear train, each said brush rotating about a vertical axis.

8. The cleaning device of claim 1 wherein said pliable elements are bristles.

9. The cleaning device of claim 8 wherein said bristles are crimped.

10. The cleaning device of claim 1 wherein said brush is rotatable.

11. The cleaning device of claim 1, wherein said brush assembly defines at least one opening for dispensing the liquid to the cleaning surface, said opening being located between said first and second sets of pliable elements.

* * * * *